US007370812B2

(12) United States Patent
Chang

(10) Patent No.: US 7,370,812 B2
(45) Date of Patent: May 13, 2008

(54) CONTROL DEVICE OF A VEHICLE RADIATOR SYSTEM

(76) Inventor: Yung-Yu Chang, No. 75, La. 223, Chung-Cheng Rd., Shan-Hua Chen, Tainan Hsien (TW)

( * ) Notice: Subject to any disclaimer, the term of this patent is extended or adjusted under 35 U.S.C. 154(b) by 578 days.

(21) Appl. No.: 11/013,917

(22) Filed: Dec. 16, 2004

(65) Prior Publication Data

US 2006/0131435 A1 Jun. 22, 2006

(51) Int. Cl.
*F01P 7/02* (2006.01)

(52) U.S. Cl. ..... 236/34; 123/41.05

(58) Field of Classification Search ..... 123/41.01, 123/41.02, 41.05, 41.12, 41.81; 236/34
See application file for complete search history.

(56) References Cited

U.S. PATENT DOCUMENTS 6,178,928 B1 * 1/2001 Corriveau ..... 123/41.12
6,453,853 B1 * 9/2002 Hawkins et al. ..... 123/41.12
2005/0066914 A1 * 3/2005 Avery et al. ..... 123/41.12

* cited by examiner

*Primary Examiner*—Chen-Wen Jiang
(74) *Attorney, Agent, or Firm*—Alan Kamrath; Kamrath & Associates PA

(57) ABSTRACT

A control device of a vehicle radiator system mainly has a temperature comparator, a temperature sensor, a keyboard and a display. The temperature sensor is positioned near an engine of the vehicle and outputs a detecting signal to the temperature comparator. Since the temperature comparator has a preset temperature value, the temperature comparator compares the preset temperature value with a current temperature value in the detecting signal to determine whether a start signal is output to a water gate driver device and a fan driver to open the water gate and start the fan drive. Since the vehicle driver sets the current temperature value through the keyboard and the preset temperature value is lower than an original fixed over-heat temperature value in the radiator system, the radiator system can be started appropriately to ensure the engine works at a safe temperature condition to prevent damage to its components.

8 Claims, 4 Drawing Sheets

CONTROL DEVICE OF A VEHICLE RADIATOR SYSTEM

BACKGROUND OF THE INVENTION

1. Field of the Invention

The present invention relates to a control device for a vehicle radiator and more particularly to a control device for a vehicle radiator that allows the thermostat to be preset to particular conditions whereby an optimum cooling effect is provided.

2. Description of Related Art

The four-stroke engine is commonly cooled by water circulating around it and the thus heated water is cooled in a radiator that has air passing over or through it. The cooling system may be actuated at a level pre-set by the manufacturer of the vehicle, however, the circumstances in which the vehicle may operate will usually vary tremendously, such as from a short drive in the depths of an icy winter to driving through a mountainous region on a very hot summer's day. This means the vehicle may overheat due to the existing cooling system operating or not operating at the most suitable time.

SUMMARY OF THE INVENTION

The main objective of the present invention is to provide a control device of a vehicle radiator system that enables the vehicle driver to preset an appropriate temperature value to start or stop the radiator system.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
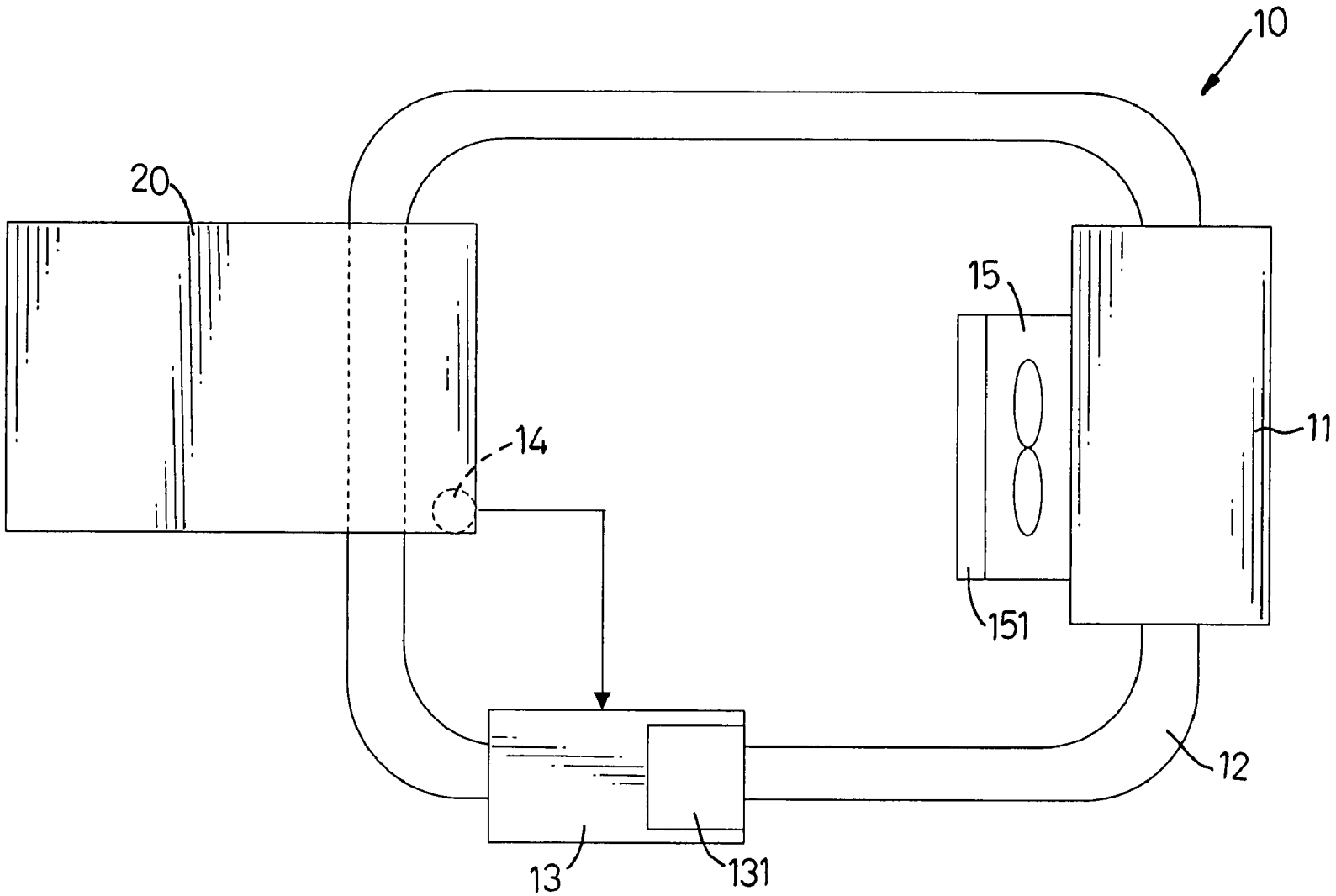
FIG. 1 is a flow diagram of an engine radiator system and an engine of a vehicle.
Figure 2:
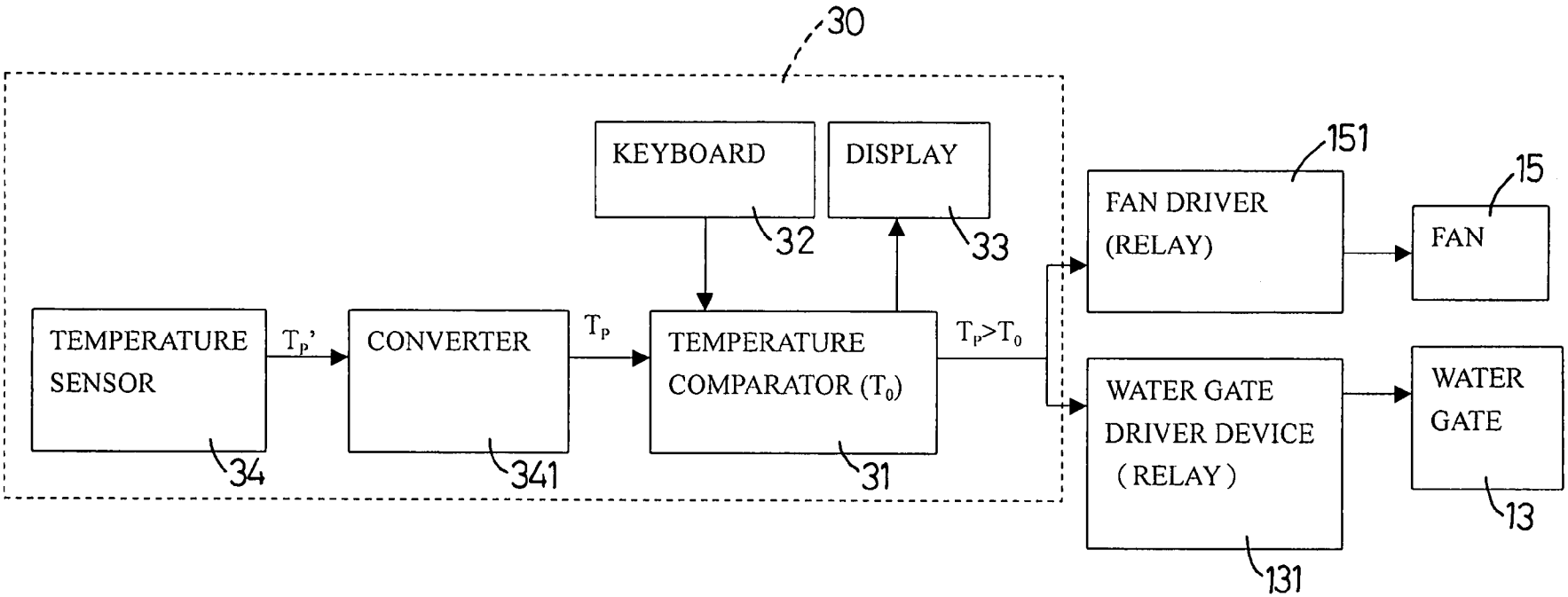
FIG. 2 is a function block diagram of a first embodiment of a control device in accordance with the present invention.

With reference to FIG. 1, a radiator system (10) mainly includes a water tank 11 used to store cooling water, a pipe (12), a water gate (13), a water gate driver device (131), a temperature sensor (14), a fan (15) and a fan driver (151). The pipe (12) forms a circuit between the water tank (11) and an engine (20). The water gate (13) is positioned in the pipe (12) and is driven by the water gate driver device (131). The temperature sensor (14) is positioned near the engine (20) to detect the temperature of the engine (20) and outputs the detecting signal to the water gate driver device (131). The water gate driver device (131) controls the water gate (13) to be in an open or closed condition based on the detecting signal of the temperature sensor (14). The water gate driver device (131) and the fan driver (151) are able to be implemented by a relay element. With further reference to FIG. 2, a first embodiment of the control device (30) of the vehicle radiator system (10) has a temperature comparator (31), a temperature sensor (34), a keyboard (32) and a display (33).

The temperature comparator (31) has a preset temperature value ($T_0$), outputs and inputs. The outputs are connected to the water gate driver device (131) and the fan driver (151) of the radiator system (10). The preset temperature value ($T_0$) is used to be a comparison reference value of the temperature comparator (31). The temperature comparator (31) includes a microprocessor.

The temperature sensor (34) is positioned near the engine (20) to detect the temperature ($T_P$) of the engine (20) and is connected to the input of the temperature comparator (31) through a converter (341). The temperature sensor (34) outputs the detecting signal ($T_P'$) and then the converter (341) transforms the detecting signal to a readable detecting signal ($T_P$) for the temperature comparator (31). The temperature comparator (31) reads a readable detecting signal and determines a current temperature value ($T_P$) of the readable detecting signal.

The keyboard (32) is connected to the input of the temperature comparator (31) and the display (33) is connected to the output of the temperature comparator (31). The vehicle driver uses the keyboard (32) to set the preset temperature value ($T_0$) of the temperature comparator (31) and the display (33) will show the preset temperature value ($T_0$) to the vehicle driver. The display (33) can be a liquid crystal display (LCD) or a light emitting diode (LED) indicator.

Figure 4:
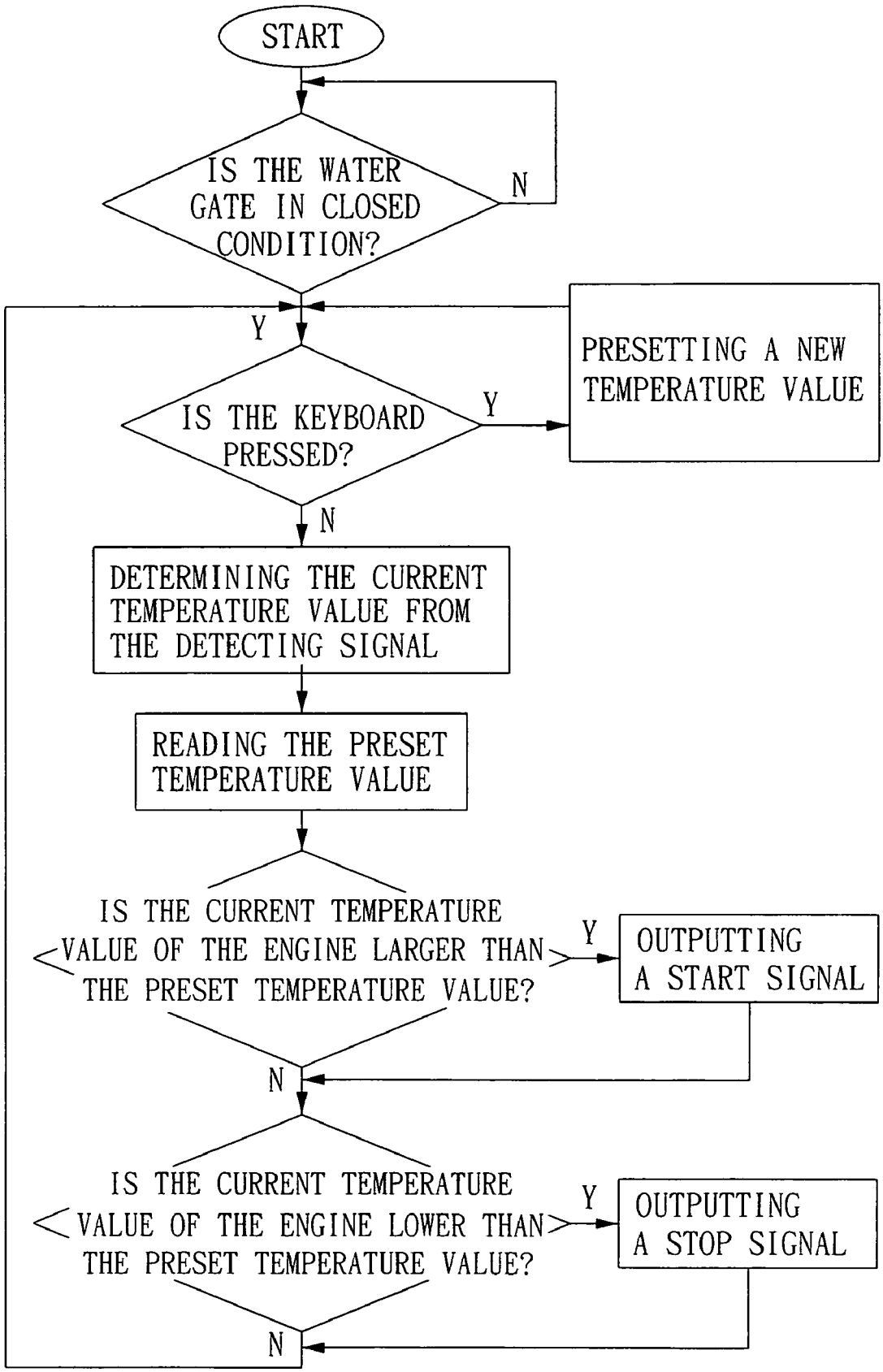
FIG. 4 is a flow chart of a temperature comparator of the control device in accordance with the present invention.

With further reference to FIG. 4, when the control device (30) in accordance with the present invention is turned on, the temperature comparator (31) firstly checks whether or not the water gate (13) is in the closed condition. The temperature comparator (31) will go to the next step when the water gate (13) is in the closed condition. In the next step, the temperature comparator (31) will detect whether the keyboard (32) is pressed or not. If the keyboard (32) is pressed, the temperature comparator (31) will enter a presetting of a new preset temperature value procedure to preset a new temperature value ($T_o$). If not, the temperature comparator (31) starts to receive the detecting signal and determines the current temperature value ($T_p$). Then, the temperature comparator (31) reads the preset temperature value ($T_o$) and compares the preset temperature value ($T_o$) with the current temperature value ($T_p$). If the current temperature value ($T_p$) is larger than the preset temperature value ($T_o$), the temperature comparator (31) will output a start signal to the water gate driver device (131) and the fan driver (151). The water gate driver device (131) will be triggered and then controls the water gate (13) to open. At the same time, the fan driver (151) will be also triggered to control the fan (15) to work. Once the water gate (13) is opened, the cooling water flows from the water tank (11) and enters the pipe (12) to decrease the temperature of the engine. The fan (15) operates to keep the cooling water of the water tank (11) at a low temperature condition. If the current temperature value ($T_p$) of the engine is lower than the preset temperature value ($T_o$), the temperature comparator (31) will output a stop signal to the water gate driver device (131) and the fan driver (151) to close the water gate (13) and turn off the fan (15). Then, the temperature comparator (31) will go back to the checking keyboard (32) step.

Figure 3:
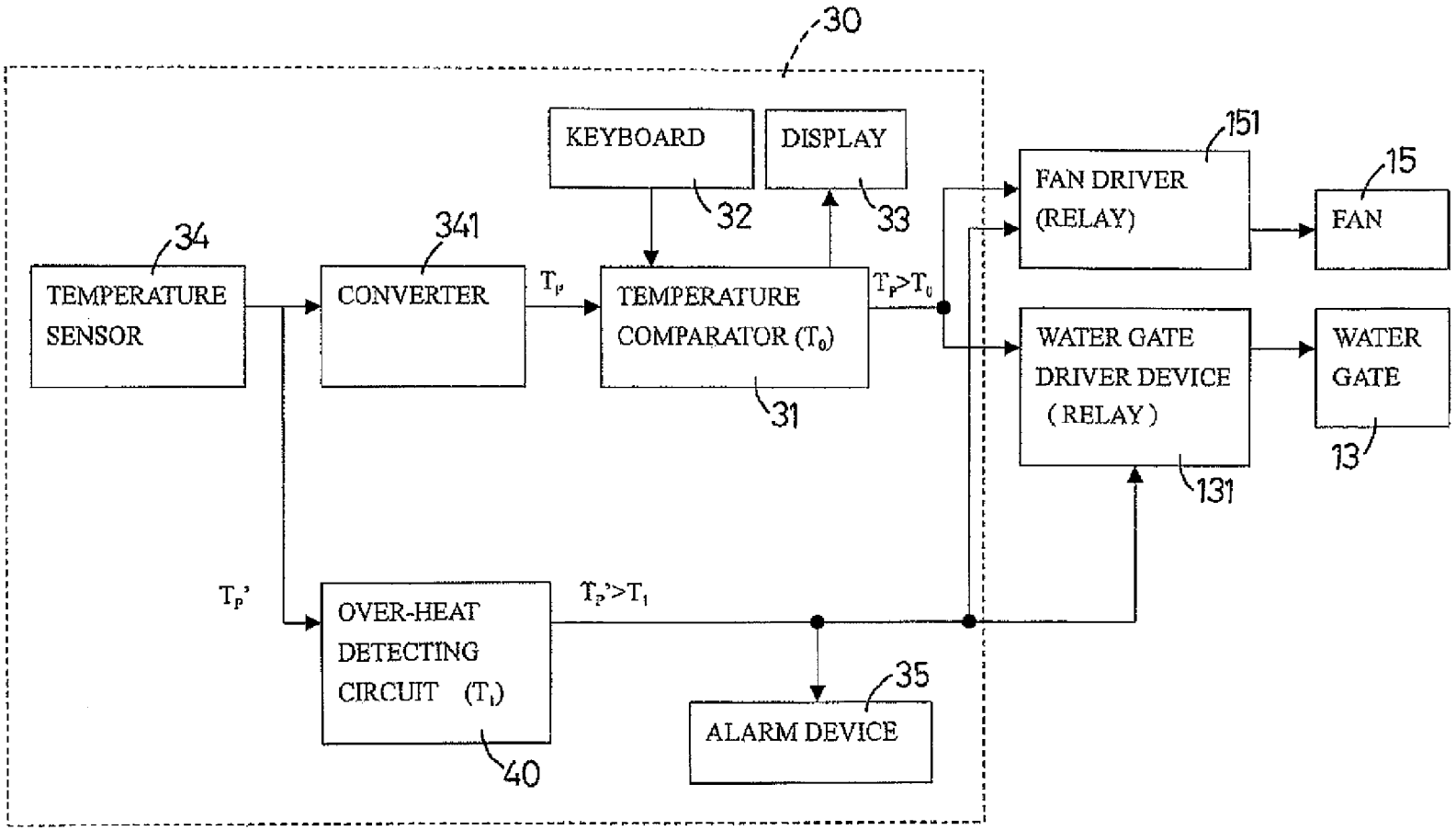
FIG. 3 is a function block diagram of a second embodiment of a control device in accordance with the present invention.

Since the radiator system (10) has one meter to indicate the temperature of the temperature sensor (34), if the vehicle driver does not often read the current temperature of the engine from the meter, the engine could become over-heated without the vehicle driver knowing this situation immediately. With reference to FIG. 3, the present invention further includes an over-heat detecting circuit (40) and an alarm device (35).

With further reference to FIG. 1, the over-heat detecting circuit (40) has the fixed over-heat temperature value ($T_1$), input terminals and output terminals. The fixed over-heat temperature value ($T_1$) is larger than the preset heat temperature value ($T_o$) of the temperature comparator (31). The input terminals are connected to the temperature sensor (34) to obtain the current temperature value ($T_p'$) of the engine (20). The output terminals are connected to the water gate driver device (131) and fan driver (151). Since the fixed over-heat temperature value ($T_1$) is larger than the preset temperature value ($T_o$), the radiator system (10) still can be driven when the temperature comparator (31) has malfunctioned. That is, the over-heat detecting circuit (40) is a backup device for driving the radiator system (10). Therefore, the current temperature value ($T_p'$) is larger than the fixed over-heat temperature value ($T_1$), and the over-heat detecting circuit (40) will output a start signal to the water gate driver device (131) and the fan driver (151). The over-heat detecting circuit will stop outputting the start signal when the current temperature value ($T_p'$) is lower than the fixed over-heat temperature value ($T_1$).

The alarm device (35) is connected to the output of the over-heat detecting circuit (40). When the over-heat detecting circuit (40) outputs the start signal, the alarm device (35) is driven and outputs the alarm signal to the vehicle driver until the over-heat detecting circuit (40) stops outputting the start signal. Thus, the vehicle driver can hear the alarm signal and notice immediately the temperature of the engine is too high to drive safely.

Based on the foregoing description, the present invention provides the following advanced functions. That is, when a vehicle manufactured for use in an area with cold weather and set with a high over-heat temperature value (100 degrees centigrade) in the radiator system, but then is driven in a different area with hotter weather, the temperature of the cooling water is not sufficiently cool as it was in the cold weather. Therefore, the vehicle driver sets a temperature value lower than the original over-heat temperature value to make the radiator device start earlier. Therefore, the present invention keeps the engine working at a safe temperature condition to ensure the engine has an optimum efficiency to prevent damage to the components of the engine.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A control device of a vehicle engine radiator system, comprising:

a temperature comparator having a preset temperature value, outputs and inputs, wherein the outputs are adapted to connect to a water gate driver device and a fan driver of a fan of a radiator system and the preset temperature value is a comparison reference value;

a temperature sensor connected to the input of the temperature comparator through a converter and adapted to be positioned near an engine to detect a temperature of the engine;

a keyboard connected to the input of the temperature comparator;

a display connected to the output of the temperature comparator; and an over-heat detecting circuit connected to the temperature sensor and having outputs and a fixed over-heat temperature value that is higher than the preset temperature value, wherein the outputs of the over-heat detecting circuit are adapted to connect to the water gate driver device and the fan driver.

2. The control device as claimed in claim 1, wherein the outputs of the over-heat detecting circuit are connected to an alarm device.

3. The control device as claimed in claim 2, wherein the alarm device comprises an indicator.

4. The control device as claimed in claim 3, wherein the alarm device comprises a speaker.

5. The control device as claimed in claim 2, wherein the alarm device comprises a speaker.

6. The control device as claimed in claim 1, wherein the display is a liquid crystal device.

7. The control device as claimed in claim 1, wherein the display is a light emitting diode indicator.

8. The control device as claimed in claim 1, wherein the temperature comparator is a microprocessor.

* * * * *